US006692286B1

(12) United States Patent
De Cet

(10) Patent No.: US 6,692,286 B1
(45) Date of Patent: Feb. 17, 2004

(54) COAXIAL PLUG CONNECTOR

(75) Inventor: Maurizio De Cet, Herisau (CH)

(73) Assignee: Huber + Suhner AG (CH)

( * ) Notice: Subject to any disclaimer, the term of this patent is extended or adjusted under 35 U.S.C. 154(b) by 0 days.

(21) Appl. No.: 10/111,215

(22) PCT Filed: Oct. 18, 2000

(86) PCT No.: PCT/CH00/00561

§ 371 (c)(1),
(2), (4) Date: Jul. 16, 2002

(87) PCT Pub. No.: WO01/31752

PCT Pub. Date: May 3, 2001

(30) Foreign Application Priority Data

Oct. 22, 1999 (EP) ..... 99810964

(51) Int. Cl.[7] ..... H01R 13/627
(52) U.S. Cl. ..... 439/352; 439/350; 439/582
(58) Field of Search ..... 439/350, 352, 439/357, 348, 578, 581, 675, 582

(56) References Cited

U.S. PATENT DOCUMENTS

| | | | | |
|---|---|---|---|---|
| 4,666,231 A | | 5/1987 | Sheesley et al. | |
| 4,674,809 A | | 6/1987 | Hollyday et al. | |
| 5,074,809 A | * | 12/1991 | Rousseau | 439/675 |
| 5,088,937 A | | 2/1992 | Gabany | |
| 5,176,533 A | * | 1/1993 | Sakurai et al. | 439/352 |
| 5,807,129 A | * | 9/1998 | Konda et al. | 439/348 |
| 5,938,465 A | * | 8/1999 | Fox, Sr. | 439/350 |
| 6,083,030 A | * | 7/2000 | Wright | 439/581 |
| 6,093,043 A | * | 7/2000 | Gray et al. | 439/352 |
| 6,250,942 B1 | * | 6/2001 | Lemke et al. | 439/352 |
| 6,464,527 B2 | * | 10/2002 | Volpe et al. | 439/352 |

FOREIGN PATENT DOCUMENTS

| | | |
|---|---|---|
| DE | 3117320 A1 | 4/1982 |
| EP | 0299772 A | 1/1989 |
| EP | 0350835 A | 1/1990 |
| EP | 0867978 A2 | 9/1998 |
| EP | 1069654 A1 | 1/2001 |

* cited by examiner

*Primary Examiner*—Alexander Gilman
(74) *Attorney, Agent, or Firm*—Webb Ziesenheim Logsdon Orkin & Hanson, P.C.

(57) ABSTRACT

The invention relates to a plug connector having a housing, which is open at a front side to enable the plugging in of a mating connector and has a channel extending therethrough. An inner conduct contact is isolated and arranged therein. Connecting means are used to mechanically connect the plug connector housing to the mating connector. The mating connector locks when it is plugged into the connecting means. The connecting means are shaped in such a manner that said agents subject the mating connector to an axial tension tensioning external conductor contact surface of said mating connector against an external conductor against an external conductor contact surface of the housing. The plug connector can be coupled with a mating connector very rapidly and securely and a reliable electrical contact is guaranteed between the external conductors.

20 Claims, 1 Drawing Sheet

Fig. 1
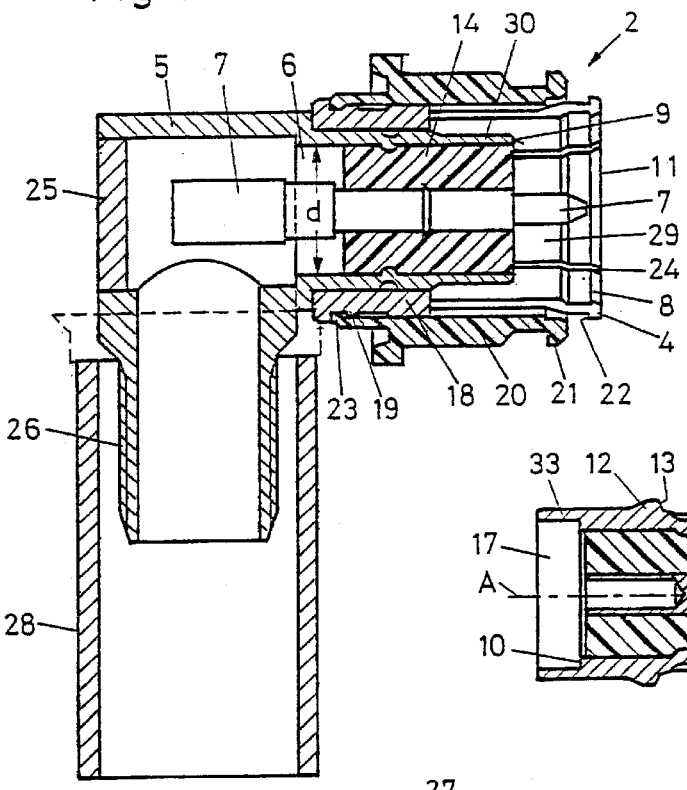
Fig. 2
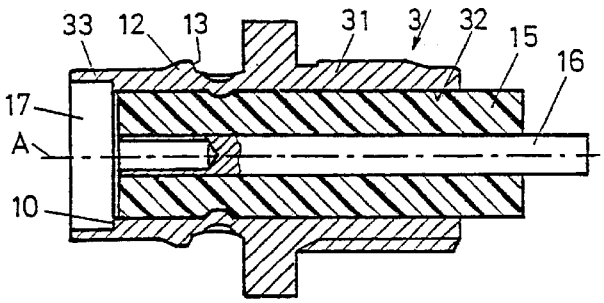
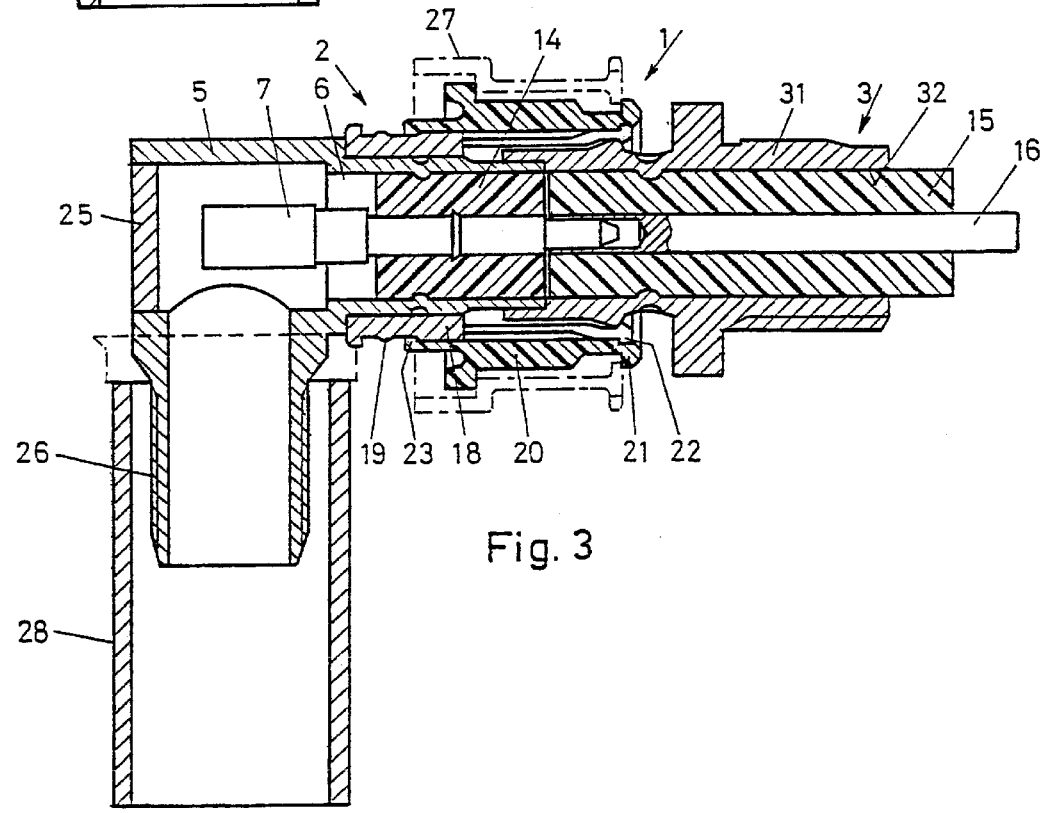
Fig. 3

COAXIAL PLUG CONNECTOR

BACKGROUND OF THE INVENTION

1. Field of the Invention

This invention relates to coaxial plug connector with a plug housing which is open on a front side to make it possible to plug in a mating connector and has a channel running through it, in which an inner conductor contact is located and isolated, with connecting means to mechanically connect the plug connector housing to the mating connector.

2. Description of the Related Art

Examples of such plug connectors of the prior art are disclosed in U.S. Pat. No. 5,088,937, DE 3 117 320 and in EP 0 867 978 A2. These plug connectors each have a male thread onto which the mating connector is screwed. By means of this threaded fastening, the two outer conductor contact surfaces are placed in contact with each other under a clamping force. This clamping force must achieve a minimum axial force to guarantee the electrical contact of the outer contact between the plug connector and the mating connector. One disadvantage of these plug connectors is that the assembly process is relatively time-consuming, and that there must be a minimum distance between the plugs in a row of plugs for the use of a tool.

SUMMARY OF THE INVENTION

The object of the invention is to create a plug connector of the type described above which can be assembled more easily and quickly and is also more reliable.

The invention teaches that this object can be achieved with a coaxial plug connector which is characterized by the fact that the mating connector locks with the connecting means when it is attached, and the connecting means are realized so that they exert an axial clamping force on the mating connector, which clamps an outer conductor contact surface of the mating connector against an outer conductor contact surface of the plug connector. The necessary axial clamping force which clamps the two outer conductor contact surfaces against each other is guaranteed by the connecting means. The connecting means make possible on one hand a very quick and easy coupling of the plug connector with the mating connector and simultaneously guarantee a minimum contact force, which can be 300 N for example. After the mating connector has been connected, the two parts are thus mechanically connected to each other and the above mentioned contact is guaranteed without the requirement for additional measures.

In one development of the invention, the connecting means have a radially flexible and elastically expandable outer conductor sleeve which can be locked with the mating connector. The mating connector can be inserted with its forward end into this outer conductor sleeve, whereby this outer conductor sleeve locks onto the mating connector. Preferably the mating connector has, on the outside, an encircling rib onto which the outer conductor sleeve can be locked. To generate the above mentioned axial clamping force, the above mentioned rib preferably has an inclined clamping surface on the back. On this clamping surface, a radial clamping force of the outer conductor sleeve can be diverted into an axial application force. This arrangement has the special advantage that the axial force is essentially independent of dimensional tolerances, because it is essentially independent of the location in which the radial force is exerted on the clamping surface.

A continuous clamping force can be guaranteed in particular if, as in one development of the invention, the outer conductor sleeve is surrounded by a locking sleeve. This locking sleeve can preferably move axially and in a working position surrounds the outer conductor sleeve. The locking sleeve preferably exerts an inwardly directed force on the outer conductor sleeve. The outer conductor sleeve diverts at least part of this radial force into the above mentioned axial clamping force.

The plug connector is preferably an SMA connector. A connector of this type has a passage running through it that has a diameter of approximately 4.1 millimeters. On such relatively small connectors, the necessary axial clamping force can be achieved with the above mentioned rib on the outside of the mating connector. The plug connector claimed by the invention can be used as an angle plug connector or as a straight-line plug connector. When it is used as an angle plug connector, it has the special advantage that the mating connector and the plug connector can be twisted continuously and at any desired angle around their common longitudinal axis in relation to each other. The bent connecting part of the plug connector can therefore be oriented accurately and at any desired angle without adversely affecting the connection.

Additional advantageous features of the invention are disclosed in the dependent claims, the following detailed description and in the accompanying drawing.

One exemplary embodiment of the invention is described in greater detail below and is illustrated in the accompanying drawings, in which:

BRIEF DESCRIPTION OF THE DRAWINGS

FIG. 1 is a sectional view of a plug connector the present invention,

FIG. 2 is a sectional view of a mating connector according to the present invention, and FIG. 3 is a sectional view of the plug connector of FIG. 1 with the attached mating connector of FIG. 2.

DETAILED DESCRIPTION OF THE PREFERRED EMBODIMENTS

The plug connector 2 has a plug housing 5 on which a connector part 26 that is bent at a right angle is shaped, and which projects into a support 28. The housing 5 is open on a front side and has a channel 6 running through it. An inner conductor contact 7 is located in the channel 6 and is isolated from the plug housing 5 by means of a sleeve-shaped insulator 14. The channel 6 is closed on the rear end by a cover 25. The plug housing 5 forms the outer conductor and on the front side has a ring-shaped encircling contact surface 9. The isolating sleeve 14 is flush with this contact surface 9, as shown.

Attached to the housing 5 is a holder 18 which can be connected to the connector housing 5 by radial compression, for example. On the holder 18 there is a clamping sleeve 11 which is provided with axial slots 24 and forms a plurality of flexible elastic snap-in pins 29. On the front side of these snap-in pins 29 there are locking lugs 8 that point radially inward. On the outside, a stop is formed by a shoulder 22. As shown, a front end 4 of the sleeve 11 projects beyond the contact surface 9 of the outer contactor sleeve 30.

A locking sleeve 20 is guided on the holder 18 so that it can move axially to a limited extent. FIG. 1 shows the locking sleeve 20 in a retracted stand-by position, in which an edge 23 that points radially inward is locked on a locking rib 10 (FIG. 3). FIG. 3 shows the locking sleeve 20 in the working position. In this position, the locking sleeve 20 is in contact with the shoulder 22 and with its forward edge 21 exerts a radial force on the clamping sleeve 11. In FIG. 3, the locking sleeve 20 is therefore pushed onto the clamping sleeve 11.

The mating connector 3 has an outer conductor in the form of an essentially cylindrical housing 31. In a channel 32 that runs all the way through this housing 31 there is a conductor 15, in which an inner conductor contact 16 is located. On the front end, the housing 31 has a cylindrical recess 17 in which there is a ring-shaped contact surface 10. This contact surface 10, as shown, is also flush with the insulator 15. At some distance from the contact surface 10, on the outside of the housing 31, there is a rib 12 that projects radially. On the back side of this rib 12 there is an encircling clamping surface 13 which, as shown in FIG. 2, is inclined at an acute angle with respect to the longitudinal axis A of the mating connector 3.

The mating connector 3 is pushed onto the plug connector 5 by axially inserting the plug connector with a forward end 33 into the clamping sleeve 11, until the two contact surfaces 9 and 10 come in contact with each other. The clamping sleeve 11 is thereby elastically expanded on the front end, and shortly before contact is made between the two contact surfaces 9 and 10, the locking lugs 8 snap in behind the rib 12 and lie against the clamping surface 13. The locking sleeve 20 is then pushed into the position shown in FIG. 3, in which position it exerts, with its edge 21, a radial force on the outer conductor sleeve 11. This force is transmitted via the locking lugs 8 and the clamping surface 13 into the mating connector 3. On account of the inclination of the clamping surface 13, there is a force component in the direction of the axis A. The axial contact force can be 300 N, for example. Because the contact surfaces 9 and 10 are relatively small, there is a relatively large surface pressure on them. That is particularly true in an SMA connector, in which the inside diameter d of the channel 6 is approximately 4.1 millimeters. A reliable electrical contact is therefore guaranteed. The plug connector 2 and the mating connector 3 are reliably connected to each other not only electrically but also mechanically. As shown in FIG. 3, the locking sleeve 20 can be located in a connecting part 27 which is drawn here in broken lines.

The connection 1 can be realized so that it is detachable or non-detachable. In a non-detachable variant, for example, the locking sleeve 20 can be secured by radial compression or in any other suitable manner to prevent displacement.

What is claimed is:

1. A coaxial plug connector with a plug housing having an opening on a front side for inserting a mating connector and having a channel running through it, in which an inner conductor contact is located and isolated, with connecting means to mechanically connect the plug housing to the mating connector, wherein the mating connector is locked in position when it is inserted into the connecting means and the connecting means are configured to exert an axial clamping force on the mating connector configured to clamp an outer conductor contact surface of the mating connector against an outer conductor contact surface of the plug housing, whereby the connecting means have a radially expandable clamping sleeve configured to be locked with the mating connector during the connection on a clamping surface and divert a radial force on the clamping surface into an axial force component, whereby the outer conductor contact surfaces are clamped against each other.

2. The plug connector as claimed in claim 1, wherein the locking sleeve is made of plastic.

3. The plug connector as claimed in claim 1, wherein the clamping sleeve is provided with at least one radial slot.

4. The plug connector as claimed in claim 3, wherein the clamping sleeve is surrounded by a locking sleeve.

5. The plug connector as claimed in claim 1, wherein the clamping sleeve is surrounded by a locking sleeve.

6. The plug connector as claimed in claim 5, wherein the locking sleeve is axially movable and, in a working position, surrounds the clamping sleeve and exerts a force that is directed radially inward on the clamping sleeve.

7. The plug connector as claimed in claim 6, wherein the locking sleeve is axially secured in a retracted stand-by position.

8. The plug connector as claimed in claim 5, wherein the locking sleeve is axially secured in a retracted stand-by position.

9. The plug connector as claimed in claim 8, wherein the locking sleeve is detachably locked in the retracted position.

10. The plug connector as claimed in claim 9, wherein the locking sleeve, in a working position, is frictionally engaged with the clamping sleeve.

11. The plug connector as claimed in claim 1, wherein the mating connector has a rib that projects radially outward.

12. The plug connector as claimed in claim 11, wherein the clamping sleeve is provided with at least one radial slot.

13. The plug connector as claimed in claim 11, wherein the clamping sleeve is surrounded by a locking sleeve.

14. The plug connector as claimed in claim 11, wherein the rib has an encircling clamping surface that is inclined with respect to the longitudinal axis of the mating connector.

15. The plug connector as claimed in claim 14, wherein the clamping sleeve has gripping means on the front end configured to grip the rib of the mating connector from behind.

16. The plug connector as claimed in claim 14, wherein the clamping sleeve is provided with at least one radial slot.

17. The plug connector as claimed in claim 14, wherein the clamping sleeve is surrounded by a locking sleeve.

18. The plug connector as claimed in claim 11, wherein the clamping sleeve has gripping means on the front end configured to grip the rib of the mating connector from behind.

19. The plug connector as claimed in claim 18, wherein the clamping sleeve is provided with at least one radial slot.

20. The plug connector as claimed in claim 18, wherein the clamping sleeve is surrounded by a locking sleeve.

* * * * *

UNITED STATES PATENT AND TRADEMARK OFFICE

CERTIFICATE OF CORRECTION

PATENT NO. : 6,692,286 B1
DATED : February 17, 2004
INVENTOR(S) : Maurizio De Cet It is certified that error appears in the above-identified patent and that said Letters Patent is hereby corrected as shown below:

Column 2,
Lines 29-31, delete "One exemplary embodiment of the invention is described in greater detail below and is illustrated in the accompanying drawings, in which:"

Signed and Sealed this

Thirteenth Day of July, 2004

JON W. DUDAS
*Acting Director of the United States Patent and Trademark Office*